US006557810B2

(12) United States Patent
Roy

(10) Patent No.: US 6,557,810 B2
(45) Date of Patent: May 6, 2003

(54) ADJUSTABLE STRUT HINGE ASSEMBLY FOR PICTURE FRAMES

(75) Inventor: Armand E. Roy, Attleboro, MA (US)

(73) Assignee: Craft, Inc., South Attleboro, MA (US)

( * ) Notice: Subject to any disclaimer, the term of this patent is extended or adjusted under 35 U.S.C. 154(b) by 0 days.

(21) Appl. No.: 10/000,183

(22) Filed: Nov. 29, 2001

(65) Prior Publication Data

US 2003/0019997 A1 Jan. 30, 2003

Related U.S. Application Data

(60) Provisional application No. 60/307,988, filed on Jul. 26, 2001.

(51) Int. Cl.[7] ..... A47G 1/24; E05D 7/12

(52) U.S. Cl. ..... 248/456; 248/296.1; 248/297.31; 40/755; 16/271; 16/362; 16/384

(58) Field of Search ..... 40/748, 750, 754, 40/755, 756; 248/454, 455, 456, 457, 459, 460, 463, 472, 296.1, 297.31; 16/270, 271, 355, 382, 384, 272, 356, 362, 364, 388, 390; 403/12, 13, 187, 319

(56) References Cited

U.S. PATENT DOCUMENTS

| | | | | | |
|---|---|---|---|---|---|
| 972,090 | A | * | 10/1910 | Ault | 16/270 |
| 1,009,500 | A | * | 11/1911 | Glathart | 16/270 |
| 1,047,148 | A | * | 12/1912 | Barcus | 16/270 |
| 1,286,694 | A | * | 12/1918 | McDonald | 16/270 |
| 1,863,323 | A | * | 6/1932 | Berne | 16/256 |
| 2,211,581 | A | * | 8/1940 | Ross | 16/364 |
| 2,825,917 | A | * | 3/1958 | Scinta | 15/250.32 |
| 3,131,659 | A | * | 5/1964 | Idomoto | 112/260 |
| 4,199,126 | A | * | 4/1980 | Komendowski | 248/174 |
| 4,407,044 | A | * | 10/1983 | Iseki | 16/237 |
| 4,979,266 | A | * | 12/1990 | Roy | 16/274 |
| 5,361,455 | A | * | 11/1994 | Kiefer | 16/235 |

* cited by examiner

*Primary Examiner*—Ramon O. Ramirez
*Assistant Examiner*—Jon Szumny
(74) *Attorney, Agent, or Firm*—Barlow, Josephs & Holmes, Ltd.

(57) ABSTRACT

A hinge assembly for adjustably connecting a picture frame strut to a picture frame back includes a mounting plate having length and a width. A first fastener, such as rosettes, are provided on the mounting plate for affixing it to the picture frame back. A hinge member includes a first plate that is slidably connected to the mounting plate. A second plate is rotatably connected to the first plate. A second fastener, such as rosettes, are provided on the second plate to affix a picture frame strut thereto.

29 Claims, 7 Drawing Sheets

ADJUSTABLE STRUT HINGE ASSEMBLY FOR PICTURE FRAMES

This application claims benefit of Ser. No. 60/307,988 filed Jul. 26, 2001.

BACKGROUND OF THE INVENTION

The present invention relates generally to hardware use for picture frames. More specifically, the present invention relates to the hardware used to attach a strut to a picture frame. In addition, the present invention relates to a hinge assembly that is used to adjustably connect a picture frame strut to a picture frame back.

In the industry, a typically picture frame assembly includes a back member, which is typically made of cardboard, which fits into a rear seat in a frame molding which can be made of wood, plastic, metal, or the like. A number of turn buttons are commonly attached to the rear side of the molding and pivot into place over the periphery of the back member to secure it in place. A piece of glass, clear plastic, or the like is positioned between the back member and the molding. A picture, to be displayed, is positioned between the back member and glass.

A picture frame may be mounted for display in several different ways. For example, a hanger or wire may be affixed to the rear side of the frame molding for hanging the frame on a wall for display. Also, a strut is typically employed when the picture frame is to be displayed on a surface, such as a desk or shelf. This strut is hingedly connected to the picture frame back. The strut is commonly shipped in with its strut member in a collapsed condition where it rests flush against the rear side of the picture frame back and frame molding. For the display of a picture frame, the strut member is opened via the hinge and the picture frame is then set on the surface with the bottom of the frame molding and free end of the strut, which is typically flat, in contact with the support surface. Thus, the picture frame is displayed in and easel-like fashion for viewing.

It is well known in the picture frame industry that struts must be positioned correctly on the picture frame back so that they operate as intended. Specifically, the strut must be of a length that enables the proper angle to be created between the picture frame itself and the support surface on which the picture frame sits. The proper length of the strut is determined not from the size of the cardboard picture frame back but the overall size of the picture frame which includes the outer molding of the frame.

Therefore, in the prior art, the strut must be positioned specifically for each overall frame size even if the actual size of the cardboard picture frame back are the same. As a result, customized permanent positioning of the strut is required in prior art picture frame assemblies. The strut must extend to the outer periphery of the molding of the frame so when it is extended it achieves the proper angle with the support surface. A further drawback of the use of a fixed strut member is that when the strut is in a collapsed state, it rests against the back of the molding thus making the overall frame much thicker and particularly cumbersome during packaging and transit. Also, the angle of the picture frame assembly relative to the support surface cannot be customized by the user.

There have been many attempts in the prior art to address the foregoing concerns of a fixed strut member. For example, prior art picture frame assemblies have included struts that are adjustably connected to the picture frame back member. This has been carried out by providing the pivot member that connects the strut to the picture frame back member with flanges that slidably reside within channels in the cardboard picture frame back. However, such a construction is difficult to operate because the metal strut hinge or pivot member and its flanges does not smoothly ride within the channels cut in the picture frame back member. Further, in this prior art construction, there is no provision to securely maintain the location of the strut hinge on the back member. Over time, the friction fit of the strut hinge in the channels of back member loosens thus enabling the hinge to migrate from its desired location which had previously been selected by the user. Numerous adjustments of such a strut hinge over time will accelerate the degradation of the quality of the adjustable strut hinge connection.

In view of the foregoing, there is a demand for an adjustable strut hinge assembly for a picture frame is easy to operate and set but yet is durable and will not degrade with use. There is a further need for an adjustable picture frame strut hinge assembly that can be manufactured in mass quantities using progressive tooling and automated equipment. There is also a demand for an adjustable picture frame strut assembly that can facilitate the compact shipping of picture frames that are equipped with a strut member.

SUMMARY OF THE INVENTION

The present invention preserves the advantages of prior art picture frame hinges and related hardware. In addition, it provides new advantages not found in currently available hinges and hardware and overcomes many disadvantages of such currently available devices and assemblies.

The invention is generally directed to the novel and unique strut hinge for picture frames that is capable of hingedly connecting a picture frame strut to a picture frame back.

The hinge assembly of the present invention adjustably connects a picture frame strut to a picture frame back and includes a mounting plate having length and a width. A first fastener, such as rosettes, are provided on the mounting plate for affixing it to the picture frame back. A pivot member includes a first plate that is slidably connected to the mounting plate. A second plate is rotatably connected to the first plate. A second fastener, such as rosettes, are provided on the second plate to affix a picture frame strut thereto. As a result, a supporting strut can be custom adjusted relative to the picture frame back to accommodate different sized picture frames and associated moldings.

The adjustable strut hinge assembly of the present invention has many advantages over prior art strut hinges in that it is easily adjustable to a wide range of positions on the picture frame back. The hinge employs a mounting plate that receives the rotating hinge member which enables easy and fast adjustment of the hinge member. An indexing system is also provided to facilitate the adjustment of the hinge assembly and to maintain the assembly in the desired adjusted position.

It is therefore an object of the present invention to provide an adjustable picture frame strut hinge assembly that can easily be adjusted so that the picture frame strut is optimally positioned relative to the picture frame back.

A further object of the present invention to provide an adjustable picture frame strut hinge assembly that is easy to manufacture and install.

It is an object to the present invention to provide an adjustable picture frame strut hinge assembly that can be manufactured quickly and in large quantities using progressive tooling.

It is a further object of the present invention to provide an adjustable picture frame strut hinge assembly that, over time, the attachment of the hinge assembly to the picture frame back does not degrade.

Another object of the present invention is to provide an adjustable picture frame strut hinge assembly where the adjusted position of the strut on the picture frame back is maintained over time.

A further object of the present invention is to provide an adjustable picture frame strut hinge assembly that is aesthetically pleasing to the eye when installed on a picture frame back.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
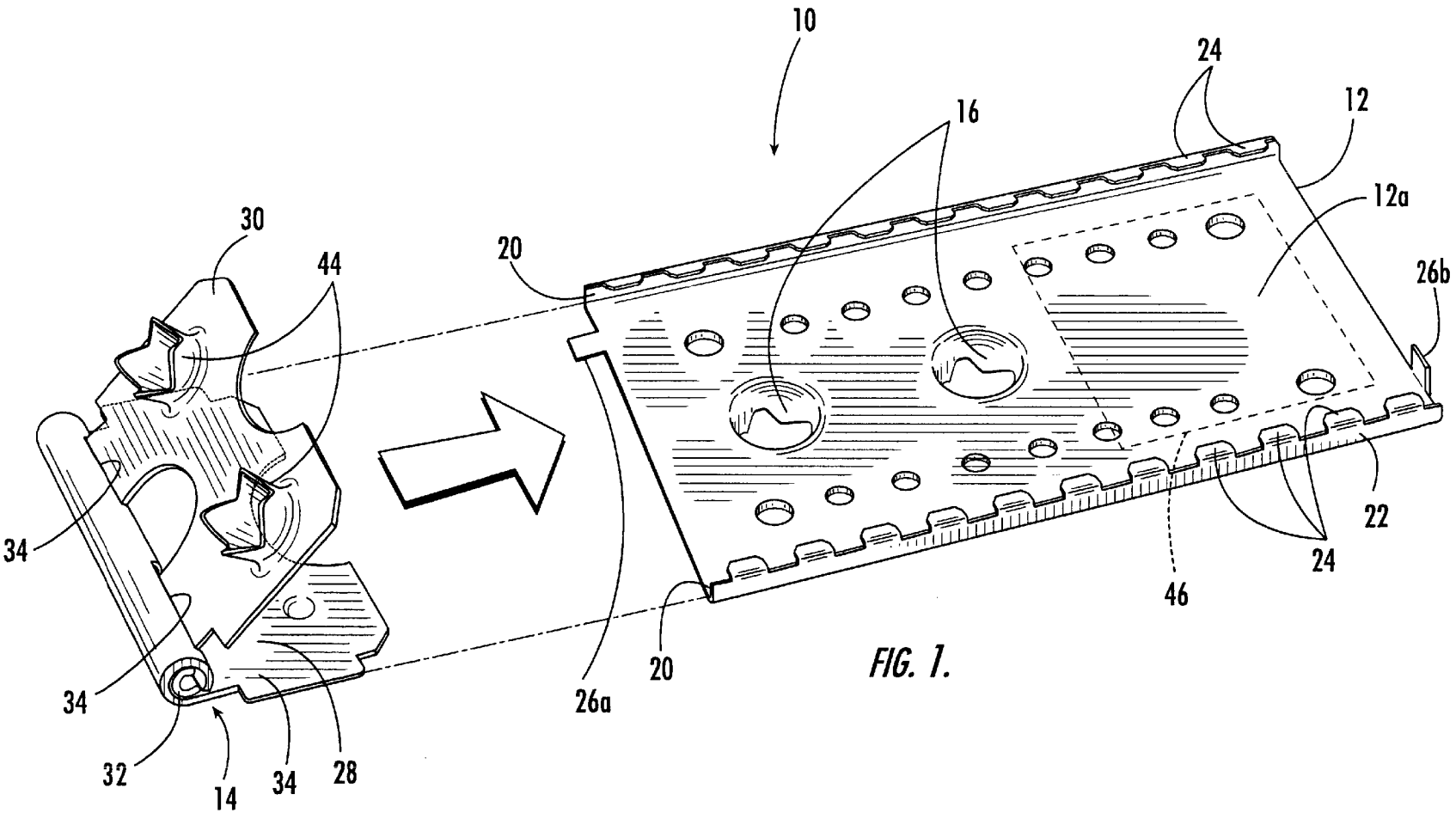
FIG. 1 is an exploded perspective view of the adjustable picture frame strut hinge assembly of the present invention.
Figure 2:
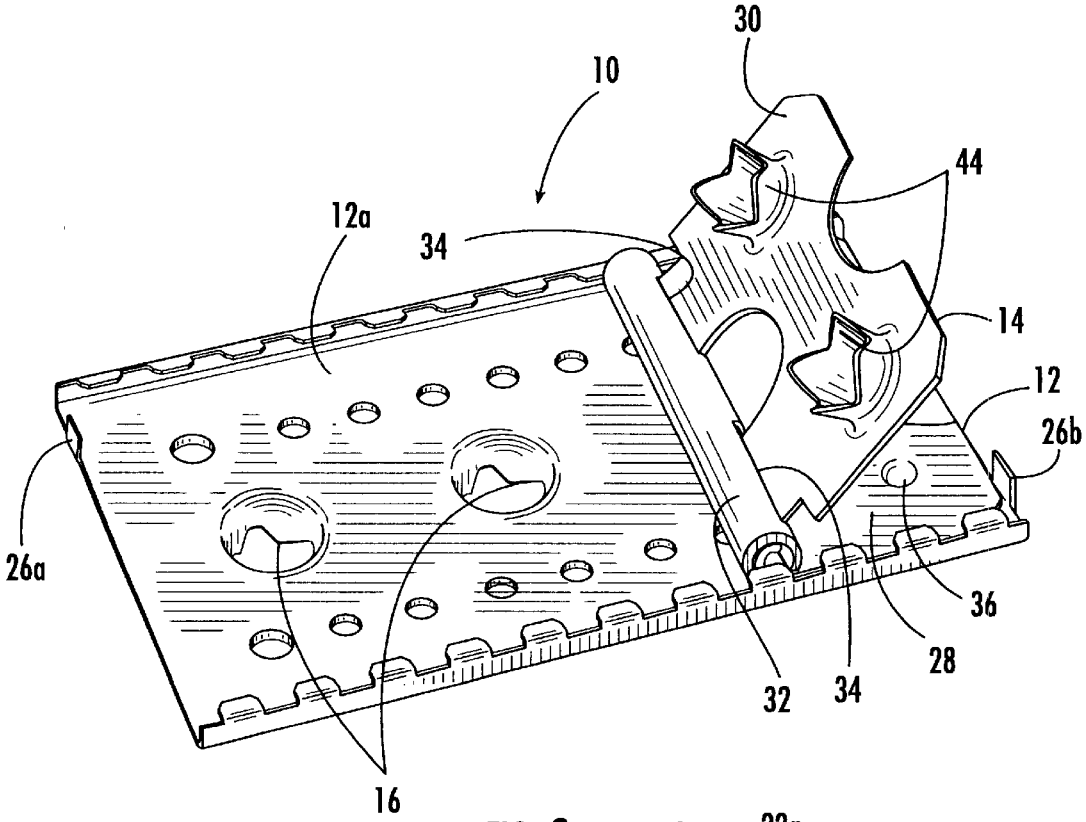
FIG. 2 is a perspective view of the adjustable picture frame strut hinge assembly of FIG. 1 in assembled form.
Figure 3:
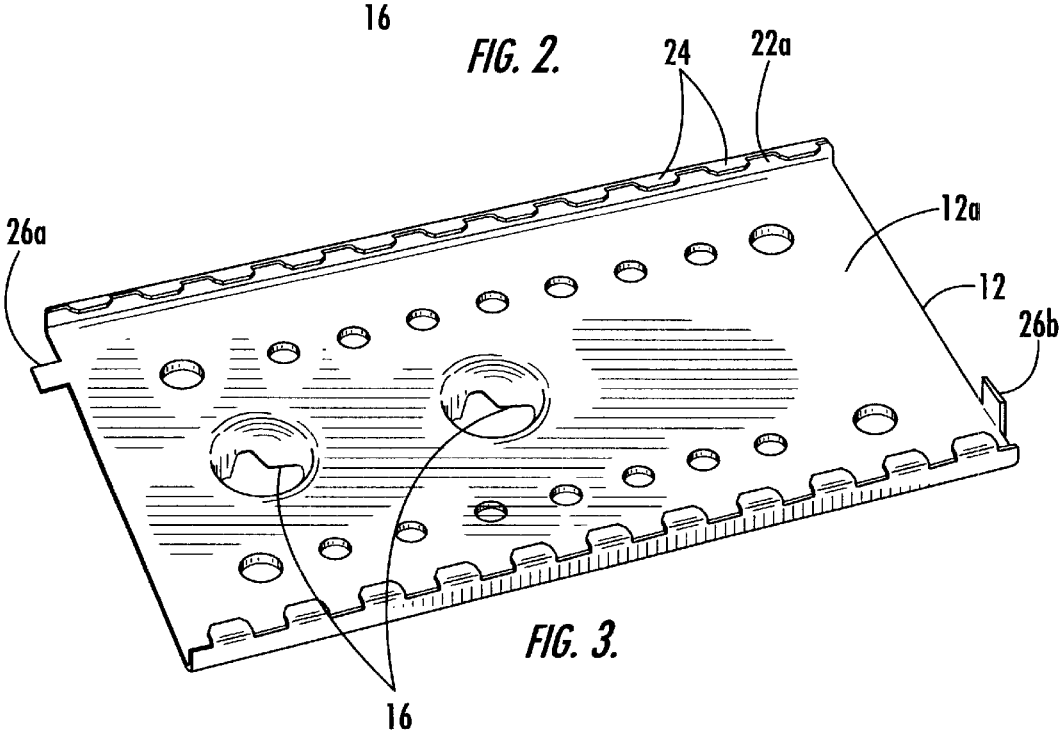
FIG. 3 is a perspective view of the mounting plate employed in the adjustable picture frame strut hinge assembly of the present invention.
Figure 10:
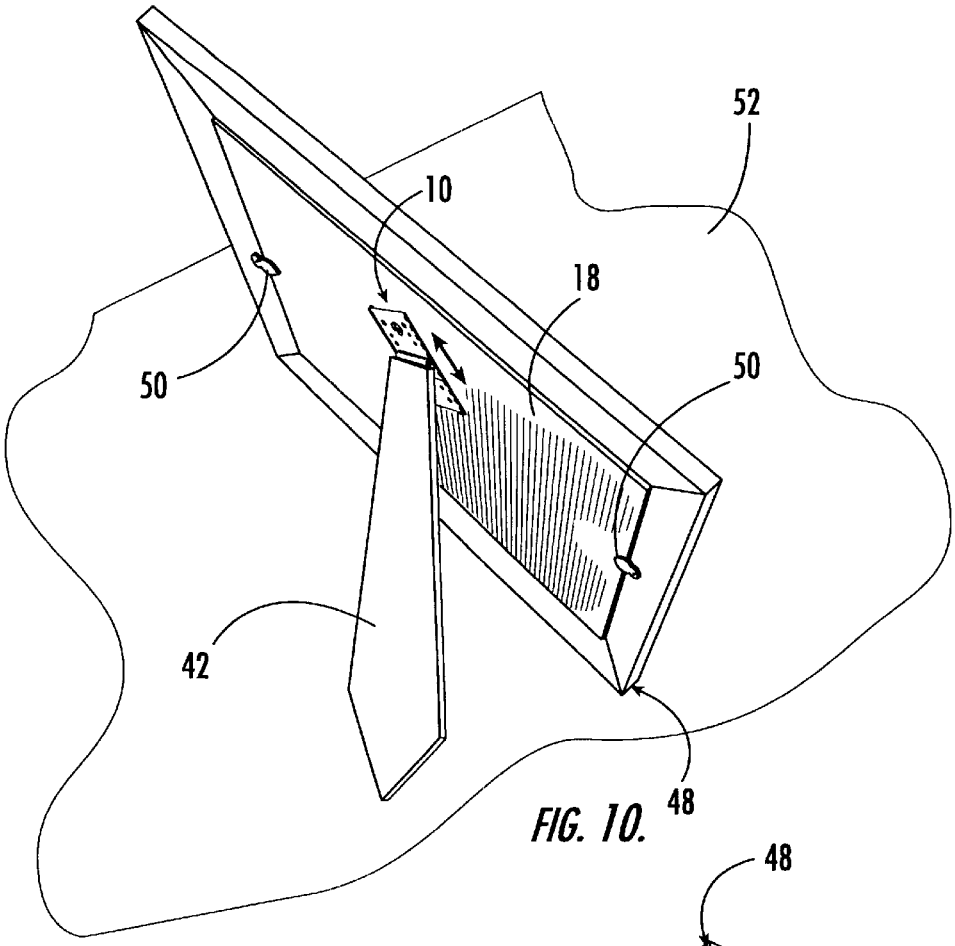
FIG. 10 is a top perspective view of a picture frame, employed the hinge assembly of the present invention, on a support surface.

Referring to FIGS. 1–3, the picture frame strut hinge assembly 10 is shown. The strut hinge assembly 10 includes a mounting plate 12 and a pivot member 14 slidably residing the in the mounting plate 12. Specifically, the mounting plate 12 includes a number of fastening members 16 which are employed to secure the mounting plate 12 to a picture frame back member 18, as shown in FIG. 10. Two fasteners 16 are preferred but one or more than two may be used. The details of such attachment will be discussed in detail below. Preferably, rosette fasteners 16 are used as the method of attaching the mounting plate 12 to a picture frame back member 18. While rosette fasteners 16 are preferred, other fasteners, such as rivets and staples, may be employed and still be within the scope of the present invention.

The mounting plate 12 includes a pair of channels 20 running along the length of the mounting plate 12 and on opposing side thereof. The channels 20 are each provided by an upstanding wall 22 and inwardly turned flanges 24. As a result, a sliding channel 20 is formed on opposing sides of the mounting plate 12 defined between the inwardly turned flanges 24 and the top surface 12*a* of mounting plate 12 as well as the inner surface 22*a* of the upstanding walls 22.

The opposing channels 20 are preferably formed as above to facilitate high speed large scale manufacturing using progressive tooling. Moreover, it is preferred that a there be an array of inwardly turned flanges 24 to enable a sharp corner to be provided to form a channel 20 that is square to facilitate smooth sliding of the pivot member 14 therein, as will be described below. However, a single inwardly turned flange 24 for each channel 20 may be employed instead. The mounting plate 12 further includes an upwardly turned stops 26, preferably in the form of a tab, to prevent removal of the pivot member 14 from within the channels 20 once it has been slidably installed therein.

Figure 4:
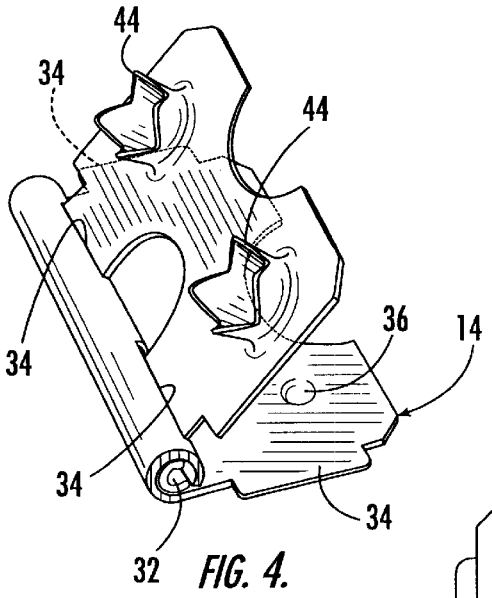
FIG. 4 is a perspective view of the hinge member employed in the adjustable picture frame strut hinge assembly of the present invention.
Figure 5:
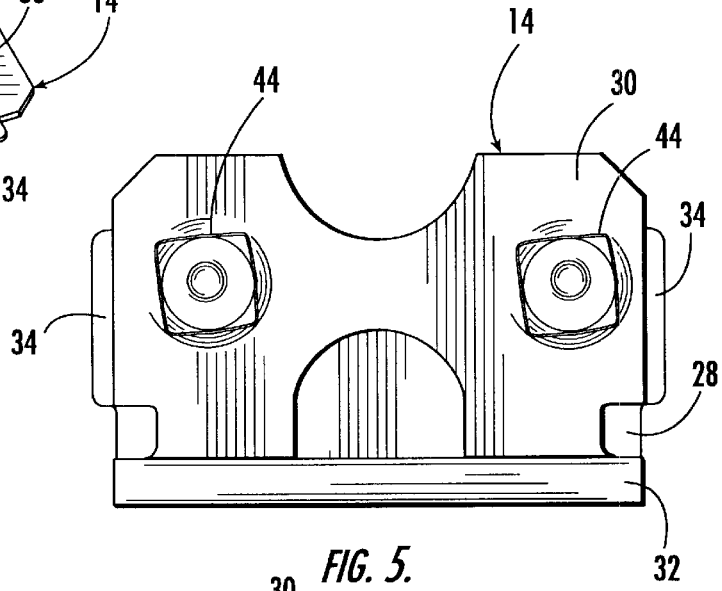
FIG. 5 is a top view of the hinge member employed in the adjustable picture frame strut hinge assembly of the present invention.
Figure 6:
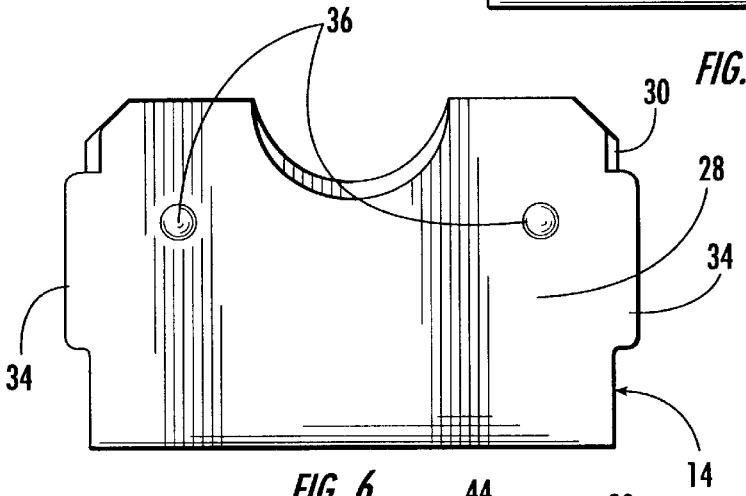
FIG. 6 is a bottom view of the hinge member employed in the adjustable picture frame strut hinge assembly of the present invention.

Turning now to FIGS. 4–6, details of the construction of the pivot member 14 is shown. The pivot member 14 is, essentially, in the form of a hinge with a bottom plate 28 with a top plate 30 that is hingedly connected thereto. For example, the hinge portion 32 is preferably of the pinless type, as shown, but may be of any construction as long as the top plate 30 is hingedly connected to the bottom plate 28. Preferably, the hinge portion 32 of the pivot member 14 has positive stops 34 to prevent the hinge from opening too far. Such at stop structure 34 may be incorporated directly into the structure of the pivot member 14 or external structures may be employed, such as chain or ribbon (not shown) attached to the back of the picture frame back member 18 to limit and control the movement hinge 32. A pair of fasteners 44, such as rosettes, are provided on the top surface of the top plate 30.

The bottom plate 28 of the pivot member 14 includes a pair of ears 34 extending from opposing sides thereof and, preferably, a pair of protrusions 36 extending downwardly from the lower surface thereof. As a result, the bottom plate 28 is attached to the mounting plate 12 by the ears 34 of the bottom plate 28 being slidably residing within the opposing channels 20 of the mounting plate 12. The sliding installation of the bottom plate 28 also installs the top plate 30 because it is hingedly connected thereto. As can be seen in FIG. 5, the ears 34 of the bottom plate 28 extend beyond the lateral boundary of the top plate 30 to enable the top plate 30 to fit between the free ends of the inwardly turned flanges 24 of the mounting plate 12 for smooth unimpeded operation.

Also, the mounting plate 12 is provided with a stops 26 for preventing the pivot member from sliding out from the channels 20. The stops 26*a* and 26*b* are preferably in the form of a pair of tabs positioned at opposing ends of the mounting plate 12. FIG. 1 illustrates the installation of the pivot member 14 into the channels of the mounting plate 12.

Figure 9:
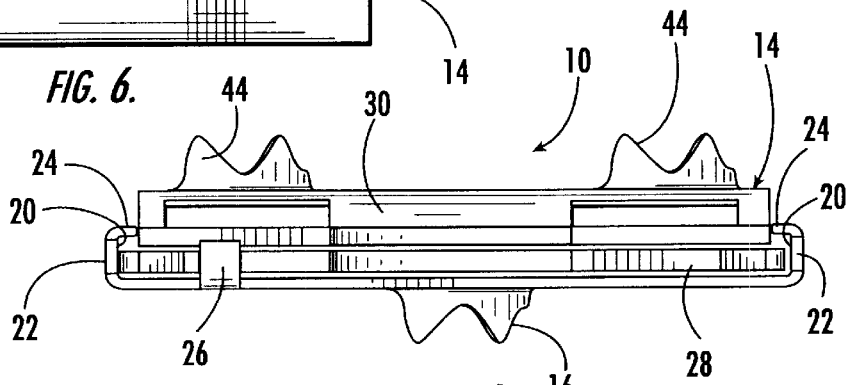
FIG. 9 is an front elevational view of the of the adjustable picture frame strut hinge assembly of FIG. 1 in assembled form.

At this point at least the tab 26*a* on the side where the pivot member 14 slidably enters the channels 20 is in a downward flat position to permit clearance of the bottom plate 28 into the channels 20. The right tab 26*b* may be already upstanding providing a right stop 26*b*. Once the pivot member 14 is installed, the left tab 26*a* is bent upward to a position as shown in FIG. 2. As a result, the pivot member 14 is secured within the mounting plate 12 via the channels 20. Alternatively, the tabs 26*a* and 26*b* may be bend upward simultaneously depending on the installation process employed. FIG. 9 further illustrates an end elevational view of the installation of the pivot member 14 into the mounting plate 12 in accordance with the present invention.

Figure 7:
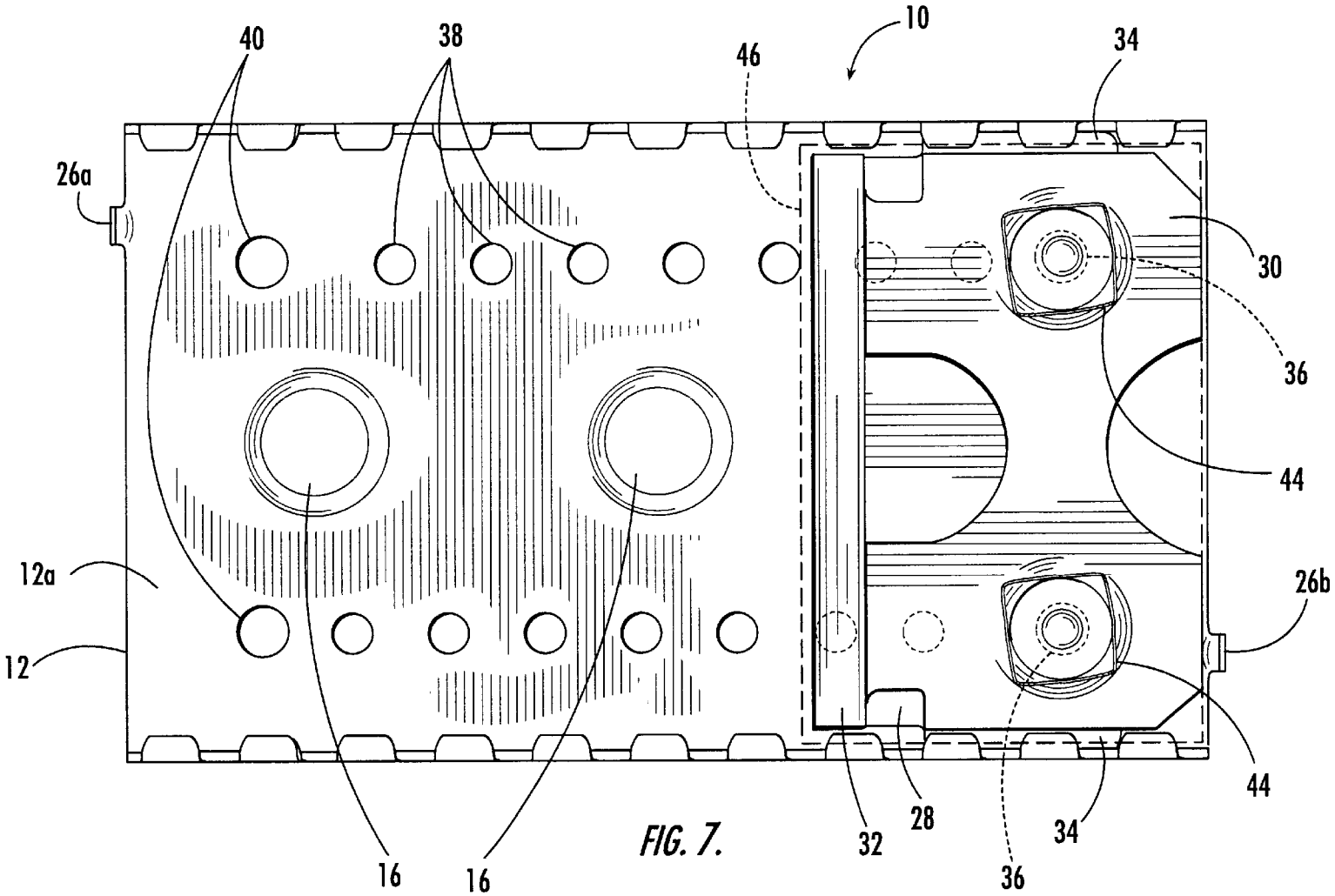
FIG. 7 is a top view of the adjustable picture frame strut hinge assembly of FIG. 1 in assembled form and in a first adjusted location.
Figure 8:
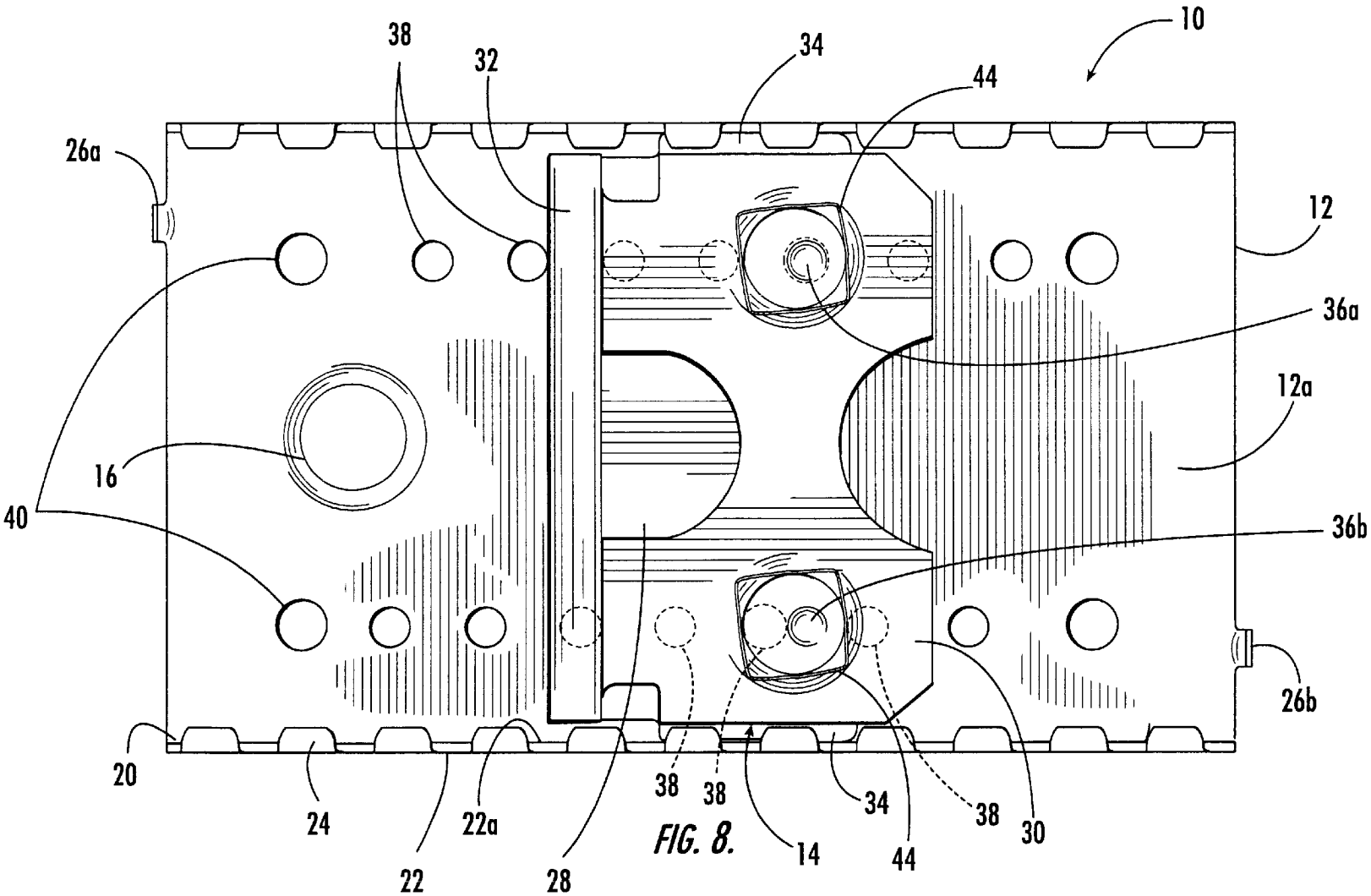
FIG. 8 is a top view of the adjustable picture frame strut hinge assembly of FIG. 1 in assembled form and in a second adjusted location.

As shown in FIGS. 6–8, the strut hinge assembly 10 is also provided with an indexing system to control the sliding movement of the pivot member 14, namely the bottom plate 28 within the channels 20 of the mounting plate 12. Specifically, as in FIG. 6, the bottom plate 28 preferably includes a pair of spaced apart protrusions 36 that extend downwardly toward the top surface 12*a* of the mounting plate 12. A pair of protrusions 36 are preferred but less or more that two protrusions 36 may be employed. When the bottom plate 28 is installed between the channels 20, namely between the inwardly facing flanges 24 and the top surface 12*a* of the mounting plate 12, there is a close tolerance fit but sliding of the bottom plate 28 and protrusions 36 thereon is permitted.

An array of apertures 38, 40 are provided through the mounting plate 12 to receive the protrusions 36 on the bottom surface of the bottom plate 28. Detents may be employed instead of a through-aperture. The array of apertures 38, 40 are used to index the sliding movement of the bottom plate and entire pivot member 14 through the mounting plate 12 and also to "park" the pivot member 14 during installation of the entire assembly 10 to a picture frame back member 18.

As the bottom plate 28 of the pivot member 14 is slidably moved, the protrusions 36 ride from adjustment hole 38 to adjustment hole 38 to enable precision adjustment of the length of a strut 42 relative to the picture frame back 18. Preferably, the adjustment holes 38 are 0.087 inch in diameter. The adjustment holes 38 are preferably arranged in two columns with the adjustment holes 38 in a column being 3⁄16 of an inch apart from one another. The columns are offset from one another so that the vertical travel distance of the pivot member 14 between an adjustment hole 38 in one column is 3⁄32 of an inch to the next adjust hole 38 in the other column. As a result, only one of the pair of protrusions 36 in the bottom plate 28 engage with an adjustment hole 38 at a time. For example, as shown in FIG. 8, the left protrusion 36*a* is engaged while the right protrusion 36*b* resides between the holes 38 in the right column. This allows for precision adjustment of the pivot member 14 relative to the mounting plate 12 to 3⁄32 of an inch. Also, since only one protrusion 36 is engaged at a time, the force required to eject a protrusion 36 from its corresponding hole 38 is lessened thus making the strut 42 easier to adjust. Of course, while not preferred, it is possible to position the holes 38 across from one another in a non-offset array where each indexing steps positions both protrusions 36 in a corresponding hole 38.

Also, at least one pair of resting holes 40 are provided proximal to the ends of the mounting plate 12 and are even with each other across the width of the mounting plate 12. These resting holes 12 are preferably 0.100 of an inch in diameter and receive the protrusions 36 of the pivot member 14 during installation of the hinge assembly 10 to a strut 42 and corresponding back 18. For proper fastening, the rosettes 16, 44 (or other fastener such as a rivet) must receive direct contact of pressure from an anvil or the like to achieve proper force to fully engage the fastener 16, 44. Therefore, the rosettes 16 on the mounting plate and the rosettes 44 on the top plate 30 must be directly exposed to an anvil, for example. For installation, the pivot member 14 is "parked" over the rest area 46 where the rosettes fasteners 16 are not present on the mounting plate 12, as shown in FIG. 7. The protrusions 36 are positioned in both of the end holes 40 which are not offset. With both protrusions 36 residing in a corresponding hole 40, the pivot member 40 is better secured during installation. In this condition, the strut hinge assembly 10 is be placed in an appropriate installation apparatus for affixation to a strut 42 and picture frame back 18.

Figure 11:
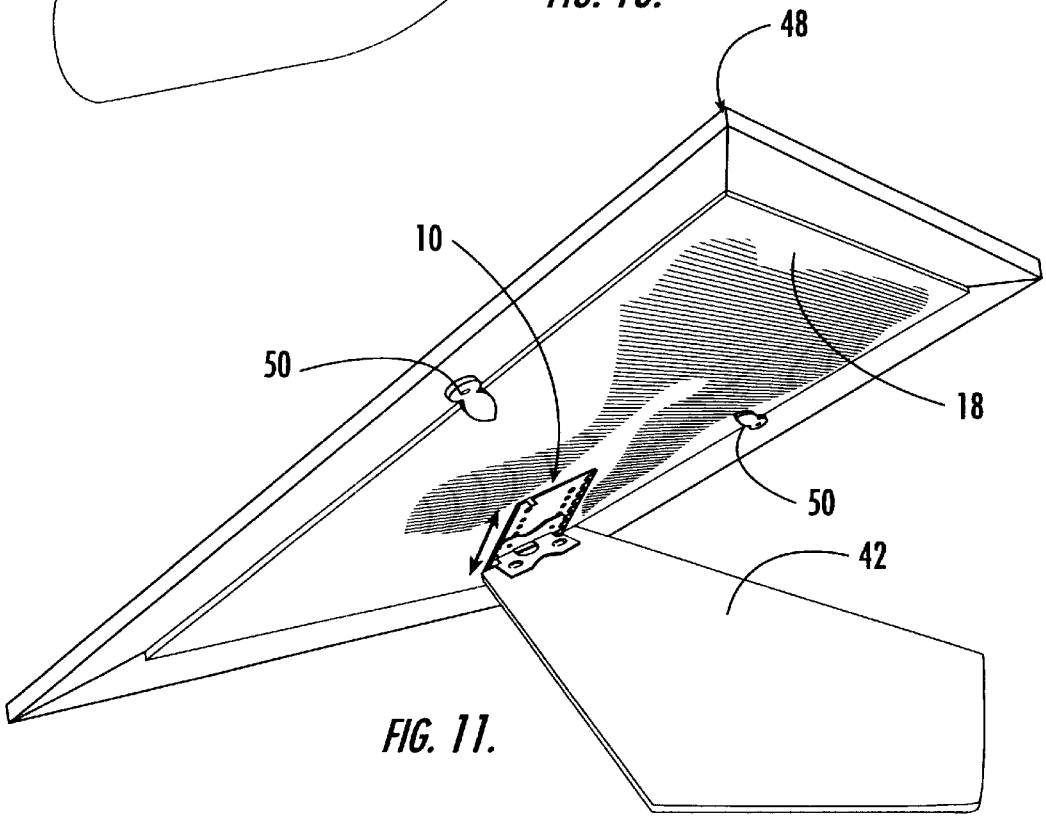
FIG. 11 is a bottom perspective view of the picture frame of FIG. 10.

Turning now to FIGS. 10 and 11, the use of the strut hinge assembly 10 on an actual picture frame 48 is shown in use. The strut hinge assembly 10 of the present invention is secured to the picture frame back 18 in the desired location and orientation. Typically, the strut member 42 itself is secured to the rosettes 44 on the top plate 30 simultaneously with securing the back member 18 to the rosettes 16 on the mounting plate 12 for the purposes described above. However, the strut 42 and the back member 18 may be affixed to the strut hinge assembly 10 of the present invention in separate steps. The picture frame back member 18 is then secured to the back of the frame molding 48 by turn buttons 50, for example. Metals tabs and other structures may be employed for this purpose. As indicated by the arrow in FIGS. 10 and 11, the strut 42 is easily slidably adjusted on the rear side of the picture frame back 18 member as desired.

Figure 12:
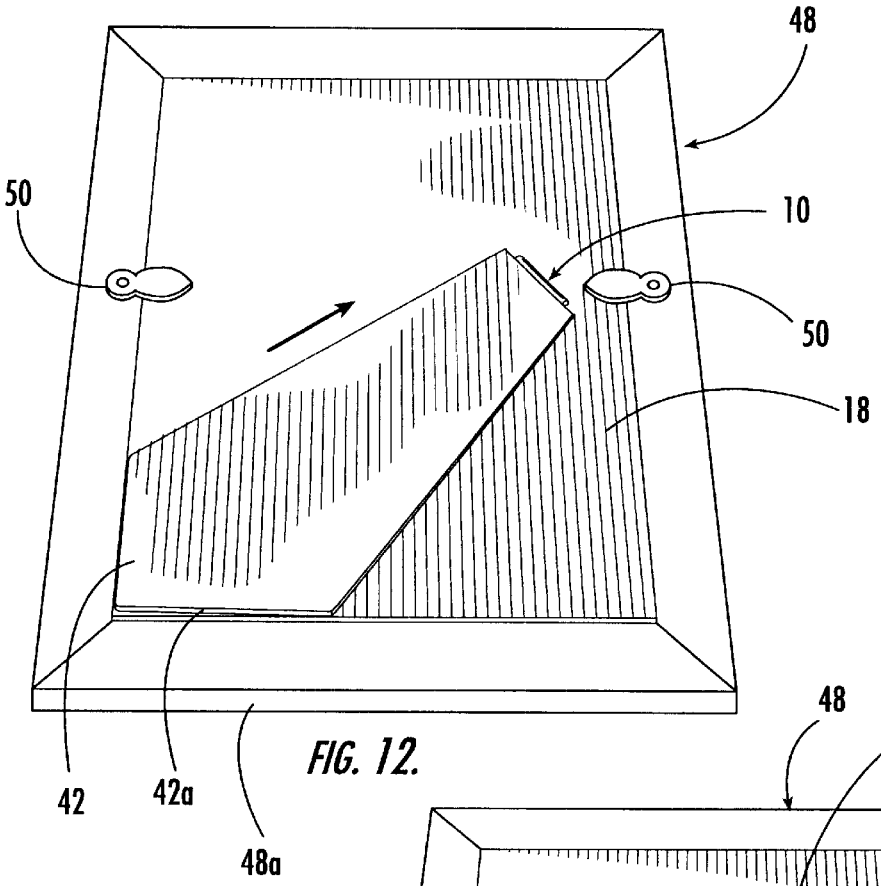
FIG. 12 is a rear view of a picture frame employing the hinge assembly of the present invention with the strut in a retracted storage position.
Figure 13:
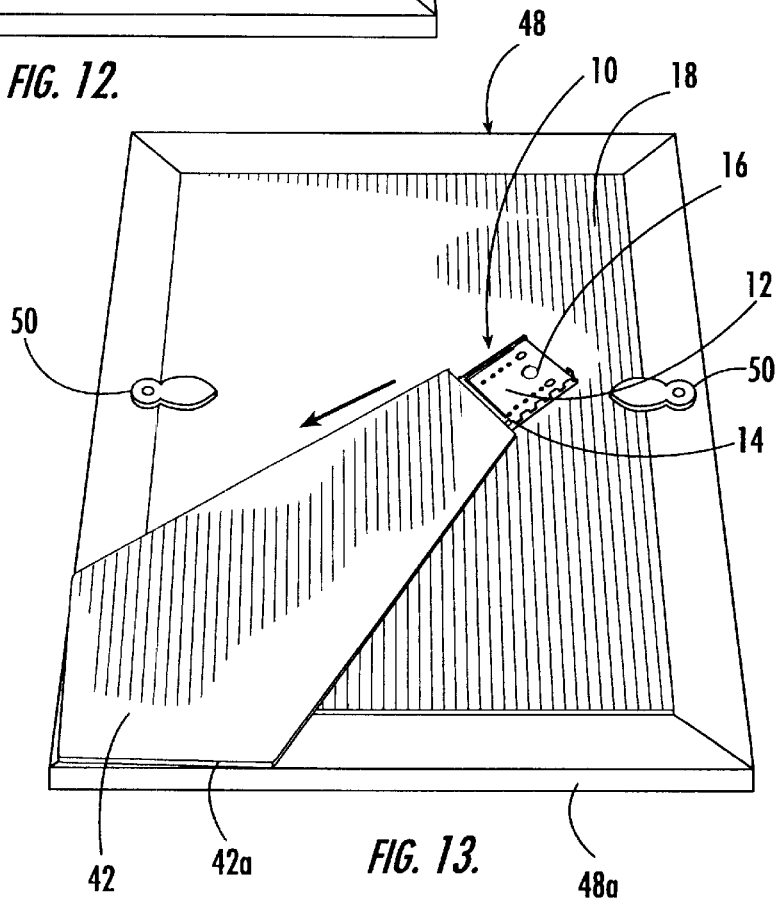
FIG. 13 is a rear view of a picture frame employing the hinge assembly of the present invention with the strut in an extended in-use position.

FIGS. 12 and 13 further illustrate the use of the adjustment ability of the present invention to facilitate packaging and transport of a picture frame 48. In FIG. 12, the strut member 42 is adjusted to be positioned as far inward as possible. In this condition, the strut 42 desirably fits within the area of the picture frame back member 18 which is commonly recessed relative to the frame molding 48. Thus, the strut 42 can be safely nested inside the boundary of the back member 18 to reduce the overall size of the entire picture frame assembly 48 for shrink-wrapping and later shipping in a compact and space efficient manner.

Actual use of the picture frame 48 with the strut member 42 in the position shown in FIG. 12 is not desired because the optimal angle of the frame 48 relative to the support surface 52 cannot be achieved. Thus, once the picture frame assembly 10 is ready to use, the user re-adjusts the strut member 42 by sliding it in the direction of the arrow in FIG. 13 so that the lower edge 42*a* of the strut member 42 substantially matches with the lower edge 48*a* of the frame molding 48. The condition of the strut member 42 in FIG. 13 renders the picture frame assembly 48 ready for normal use. If desired, for example if the frame 48 needs to be moved, the strut 42 can be slidably adjusted back to the condition in FIG. 12 for compact transport.

The adjustable strut hinge assembly 10 of the present invention is preferably made of stamped metal using progressive tooling for ease and speed of assembly. However, other materials, such as plastic, may be employed and still be within the scope of the present invention.

In view of the foregoing, a sturdy and easy to install and use adjustable strut hinge assembly 10 is provided for picture frames 48 to greatly facilitate the shipping and customization of a picture frame 48.

It would be appreciated by those skilled in the art that various changes and modifications can be made to the illustrated embodiments without departing from the spirit of the present invention. All such modifications and changes are intended to be covered by the appended claims.

What is claimed is:

1. An assembly for adjustably connecting a member to a substrate, comprising:

a mounting plate having length and a width, and a top surface;

first fastening means connected to the mounting plate for affixing the mounting plate to a substrate;

a first plate having a length; a width;

means for slidably connecting the first plate to the mounting plate along the length of the mounting plate;

a protrusion extending from the first plate and capable of communication with the mounting plate; the protrusion having a rounded seat engaging surface;

a first seat provided in the mounting plate;

a second seat provided in the mounting plate; said second seat being in spaced apart relation to the first seat and aligned longitudinally therewith along the length of the mounting plate; the protrusion being removably engageable with the first seat and the second seat with the rounded seat engaging surface being capable of riding along and in communication with the top surface of the mounting plate and riding in and out of the first seat and second seat; whereby slidable connection of the first plate to the mounting plate along the length thereof is controlled by releasable engagement of the protrusion with the first seat and the second seat;

a second plate rotatably connected to the first plate; and second fastening means connected to the second plate for affixing a member thereto.

2. The assembly of claim 1, further comprising:

means for preventing disconnection of the first plate to the mounting plate.

3. The assembly of claim 2, wherein the means for preventing is stops emanating upwardly from the mounting plate at opposing sides of the mounting plate with no flanges connected thereto.

4. The assembly of claim 1, wherein the first fastening means is at least one rosette fastener.

5. The assembly of claim 1, wherein the second fastening means is at least one rosette fastener.

6. The assembly of claim 1, wherein the means for slidably connecting the first plate to the mounting plate comprises:

a pair of opposing flanges, each with inwardly turned lips, defining a sliding channel therebetween; the pair of opposing flanges being connected to the mounting plate;

a pair of opposing tabs connected to opposing sides of the first plate and being respectively slidable within the channel.

7. The assembly of claim 1, wherein the mounting plate, first plate and second plate are made of metal.

8. The assembly of claim 1, further comprising:

a third seat provided in the mounting plate located adjacent to the first seat across the width of the mounting plate; and a fourth seat provided in the mounting plate located adjacent to the second seat across the width of the mounting plate.

9. The assembly of claim 8, further comprising:

a second protrusion extending from the first plate located adjacent to the first protrusion across the width of the first plate; the first protrusion and the second protrusion being releasably engageable with the first seat and the third seat at a first position and releasably engageable with the second seat and the fourth seat at a second position.

10. The assembly of claim 9, wherein two adjacent columns of seats are positioned along a substantial portion of the length of the mounting plate.

11. The assembly of claim 10, wherein a portion of the mounting plate includes seats which are not aligned with seats of an adjacent column across the width of the mounting plate.

12. The assembly of claim 10, wherein a portion of the mounting plate includes seats which are aligned with seats of an adjacent column across the width of the mounting plate.

13. An assembly for adjustably connecting a member to a substrate, comprising:

a mounting plate having length, a width, opposing side edges and opposing end edges;

first fastening means connected to the mounting plate for affixing the mounting plate to a substrate;

a pair of side walls, having free ends, respectively extending upwardly from the opposing side edges of the mounting plate;

a pair of inwardly turned flanges respectively connected to the free ends of the pair of side walls; the pair of side walls and pair of inwardly turned flanges defining a pair of facing grooves running along the length of the mounting plate:

a first plate having a length, a width and opposing side edges; a pair of tabs respectively connected to the opposing side edges of the first plate; the pair of tabs being respectively slidable within the pair of facing grooves;

a second plate rotatably connected to the first plate;

second fastening means connected to the second plate for affixing a member thereto; and at least one protrusion extending from the first plate and capable of communication with the mounting plate;

a plurality of seats, corresponding with the at least one protrusion, provided in the mounting plate; the at least one protrusion being respectively removably engageable with each of the plurality of seats when the first plate is positioned at different locations along the length of the mounting plate; the plurality of seats are two adjacent columns of seats running along a substantial portion of the length of the mounting plate; a portion of the mounting plate including seats which are not aligned with seats of an adjacent column across the width of the mounting plate;

whereby slidable connection of the first plate to the mounting plate is controlled by releasable engagement of the at least one protrusion with the at least one seat.

14. The assembly of claim 13, wherein the first fastening means is a rosette fastener.

15. The assembly of claim 13, wherein the second fastening means is a rosette fastener.

16. An assembly for adjustably connecting a member to a substrate, comprising:

a mounting plate having length, a width, opposing side edges, opposing end edges, and a top surface;

first fastening means connected to the mounting plate for affixing the mounting plate to a substrate;

a pair of side walls, having free ends, respectively extending upwardly from the opposing side edges of the mounting plate;

a pair of inwardly turned flanges respectively connected to the free ends of the pair of side walls; the pair of side walls and pair of inwardly turned flanges defining a pair of facing grooves running along the length of the mounting plate;

a first plate having a length, a width and opposing side edges; a pair of tabs respectively connected to the opposing side edges of the first plate; the pair of tabs being respectively slidable within the pair of facing grooves;

a second plate rotatably connected to the first plate;

second fastening means connected to the second plate for affixing a member thereto; and rounded protrusion means for removably securing the first plate to the mounting plate at different positions along the length of the mounting plate; said rounded protrusion means having a seat engaging surface and being capable of riding along and in communication with the top surface of the mounting plate and riding in and out of a plurality of seats at different locations along the length of the mounting plate; whereby slidable connection of the first plate to the mounting plate is controlled by releasable engagement of the rounded protrusion with the plurality of seats.

17. The assembly of claim 16, further comprising:

means for preventing disconnection of the first plate to the mounting plate.

18. The assembly of claim 17, wherein the means for preventing is a pair of stops respectively emanating upwardly from the end edges of the mounting plate.

19. The assembly of claim 16, wherein the first fastening means is at least one rosette fastener.

20. The assembly of claim 16, wherein the second fastening means is at least one rosette fastener.

21. The assembly of claim 16, wherein the mounting plate, first plate and second plate are made of metal.

22. The assembly of claim 16, wherein said plurality of seats are positioned along a substantial portion of the length of the mounting plate.

23. The assembly of claim 16, wherein said rounded protrusion means is a pair of rounded protrusions positioned across the width of the first plate.

24. The assembly of claim 16, wherein said plurality of seats are two adjacent columns of seats running along a substantial portion of the length of the mounting plate.

25. The assembly of claim 24, wherein a portion of the mounting plate includes seats which are not aligned with seats of an adjacent column across the width of the mounting plate.

26. The assembly of claim 24, wherein a portion of the mounting plate includes seats which are aligned with seats of an adjacent column across the width of the mounting plate.

27. An assembly for adjustably connecting a member to a substrate, comprising:

a mounting plate having length and a width;

first fastening means connected to the mounting plate for affixing the mounting plate to a substrate;

a first plate having a length and a width;

means for slidably connecting the first plate to the mounting plate;

a second plate rotatably connected to the first plate;

second fastening means connected to the second plate for affixing a member thereto;

at least one protrusion extending from the first plate and capable of communication with the mounting plate; said at least one protrusion is a pair of protrusions positioned across the width of the first plate;

at least one seat, corresponding with the at least one protrusion, provided in the mounting plate; the at least one protrusion being respectively removably engageable with the at least one seat; said at least one seat is two adjacent columns of seats running along a substantial portion of the length of the mounting plate; a portion of the mounting plate including seats which are not aligned with seats of an adjacent column across the width of the mounting plate; and whereby slidable connection of the first plate to the mounting plate is controlled by releasable engagement of the at least one protrusion with the at least one seat.

28. The assembly of claim 27, wherein the first fastening means is a rosette fastener.

29. The assembly of claim 27, wherein the second fastening means is a rosette fastener.

* * * * *